US011073162B2

(12) United States Patent
Hermes

(10) Patent No.: US 11,073,162 B2
(45) Date of Patent: Jul. 27, 2021

(54) RETURN STAGE OF A MULTI-STAGED COMPRESSOR OR EXPANDER WITH TWISTED GUIDE VANES

(71) Applicant: Siemens Aktiengesellschaft, Munich (DE)

(72) Inventor: Viktor Hermes, Duisburg (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 129 days.

(21) Appl. No.: 16/483,424

(22) PCT Filed: Jan. 9, 2018

(86) PCT No.: PCT/EP2018/050397
§ 371 (c)(1),
(2) Date: Aug. 4, 2019

(87) PCT Pub. No.: WO2018/145838
PCT Pub. Date: Aug. 16, 2018

(65) Prior Publication Data

US 2020/0011345 A1 Jan. 9, 2020

(30) Foreign Application Priority Data

Feb. 10, 2017 (EP) ..... 17155607

(51) Int. Cl.
*F04D 29/44* (2006.01)

(52) U.S. Cl.
CPC ..... *F04D 29/44* (2013.01)

(58) Field of Classification Search
CPC ..... F04D 17/12; F04D 29/444
See application file for complete search history.

(56) References Cited

U.S. PATENT DOCUMENTS 7,717,672 B2 * 5/2010 Barton ..... F04D 29/624 415/208.2
2007/0036647 A1 2/2007 Abdelwahab et al.
2010/0272564 A1 10/2010 Richter et al.

FOREIGN PATENT DOCUMENTS

CA 1252075 A 4/1989
CH 577114 A5 6/1976
CN 101263305 A 9/2008
(Continued)

OTHER PUBLICATIONS

Translation of JP2004150404 (Year: 2004).*
(Continued)

*Primary Examiner* — Woody A Lee, Jr.
*Assistant Examiner* — Brian O Peters

(57) ABSTRACT

A return stage through which a process fluid is designed to flow along a throughflow direction of a radial turbomachine, wherein the return stage extends in annular fashion about an axis and is defined radially inwardly by an inner delimiting contour and radially outwardly by an outer delimiting contour. At least one guide vane stage including guide vanes extends at least along a part of the third section and segments the return stage in the circumferential direction into flow channels, wherein in each case a profile midline of a profile cross section defines an inner track on the side of the inner delimiting contour and an outer track on the side of the outer delimiting contour. A radial turbomachine includes at least one such return stage.

12 Claims, 4 Drawing Sheets

(56) References Cited

FOREIGN PATENT DOCUMENTS

| | | | | | |
|---|---|---|---|---|---|
| CN | 104121203 | A | | 10/2014 | |
| DE | 3430307 | A1 | | 4/1985 | |
| DE | 102014203251 | A1 | | 8/2015 | |
| EP | 0592803 | A1 | | 4/1994 | |
| GB | 969125 | | * | 9/1964 | |
| GB | 1471222 | A | | 4/1977 | |
| JP | S562499 | A | | 1/1981 | |
| JP | S5641496 | A | | 4/1981 | |
| JP | H10331793 | A | | 12/1998 | |
| JP | H11173299 | A | | 6/1999 | |
| JP | 2004150404 | | * | 5/2004 | ..... F04D 17/122 |
| JP | 2012102712 | A | | 5/2012 | |
| WO | 2014072288 | A1 | | 5/2014 | |

OTHER PUBLICATIONS

PCT International Search Report and Written Opinion of International Searching Authority dated Apr. 25, 2018 corresponding to PCT International Application No. PCT/EP2018/050397 filed Jan. 9, 2018.

Zhao Xingren; "Industrial Equipment Installation Engineering"; Dec. 31, 1991; pp. 349-350; [with Machine translation p. 1].

Zhu Changyun; Qin Guoliang; "Fluid Machinery"; Analysis and Comparison of the Inner Flow for Two Return Channel of the Stage of the Centrifugal Compressor; May 31, 2012; pp. 46-49; [with English abstract p. 1].

CN search report translated from CN Office Action dated Apr. 21, 2020.

* cited by examiner

RETURN STAGE OF A MULTI-STAGED COMPRESSOR OR EXPANDER WITH TWISTED GUIDE VANES

CROSS REFERENCE TO RELATED APPLICATIONS

This application is the US National Stage of International Application No. PCT/EP2018/050397 filed Jan. 9, 2018, and claims the benefit thereof. The International Application claims the benefit of European Application No. EP17155607 filed Feb. 10, 2017. All of the applications are incorporated by reference herein in their entirety.

FIELD OF INVENTION

The invention relates to a return stage for throughflow by means of a process fluid along a throughflow direction of a radial turbomachine, in particular radial turbocompressor return stage, wherein the return stage extends about an axis in a ring-shaped manner, wherein the return stage is defined radially inwardly by an inner delimiting contour and radially outwardly by an outer delimiting contour, wherein the return stage extends radially outwardly in a first section along a first throughflow direction, wherein the return stage extends, in a manner describing an arcuate deflection, radially inwardly from radially outside along the first throughflow direction in a second section, wherein the return stage extends radially inwardly from radially outside along the first throughflow direction in a third section, wherein the return stage extends, in a manner describing an arcuate deflection, axially from radially inside along the first throughflow direction in a fourth section, wherein at least one guide vane stage comprising guide vanes extends at least along a part of the third section and, in the circumferential direction, segments the return stage into flow channels, wherein in each case a profile midline of a profile cross section of the guide vanes of the guide vane stage defines an inner track on the side of the inner delimiting contour and an outer track on the side of the outer delimiting contour. The invention also relates to a radial turbomachine, in particular a radial turbocompressor, having at least one return stage of said type.

BACKGROUND OF INVENTION

Radial turbomachines are known either as radial turbocompressors or radial turboexpanders. The embodiments below—unless indicated otherwise—relate to the embodiment as compressor. The invention is, in principle, equally applicable to expanders as to compressors, wherein, in relation to a radial turbocompressor, a radial turboexpander essentially provides a reverse flow direction of the process fluid.

In a radial turboexpander, with expansion and deflection of a process fluid, the energy stored thermodynamically in the process fluid is converted to technical work by means of the drive of the impeller.

The process is reversed in radial turbocompressors, which convert into, or store as, flow work technical work, said flow work being stored thermodynamically in the process fluid. For this purpose, impellers of the compressor generally suck in a process fluid axially with respect to an axis of rotation, or obliquely with respect to the axis of rotation with an axial speed component, and accelerate and compress said process fluid by means of the respective impeller, which deflects the flow direction of the process fluid into the radial direction.

In a multi-stage radial turbocompressor, a return stage follows downstream of the impeller if at least one further impeller is provided downstream.

In the terminology of this invention, a multi-stage radial turbomachine means that multiple impellers are arranged in a manner rotatable about the same axis of rotation. Here, an impeller amounts to a stage of the radial turbomachine. The multi-stage design gives rise to the requirement that, in the case of the compressor, the process fluid flowing out radially from the impellers has to be guided back in the direction of the axis of rotation and, with an axial speed component, can flow into the following impeller of the downstream stage. The flow guiding arrangement which makes possible this return of the process fluid is therefore called "return stage". In the case of a turboexpander, the component may be of identical form and is flowed through merely in the reverse direction.

In addition to the return of the process fluid in the direction of the axis of rotation and the deflection of the flow direction of the process fluid into the axial direction, guide vanes are also provided in a regular manner in the return stages, which guide vanes at least partially or completely neutralize swirl imparted to the flow from the upstream impeller, or even impart swirl in the opposite direction for the entry into the next downstream stage.

The normal formation of a return stage provides that, by means of a so-called intermediate base, this complete component is, by means of suitable supports, generally supported and oriented in a housing or some other support device. The return stage also comprises a so-called vane base, which is fastened to the intermediate base with the above-elucidated guide vanes so as to form a return channel. The process fluid flows to the next impeller inlet through the return channel. With this structure, the guide vanes perform two functions. Firstly, the guide vanes have the aerodynamic function of imparting counter-swirl to the process fluid to such an extent that at least the swirl from the upstream stage is substantially compensated, and secondly, the guide vanes have the mechanical task of fastening the vane base to the intermediate base such that, despite the dynamic loading, secure retention is ensured.

The documents DE102014203251A1, DE 34 303 07 A1 and EP 592 803 B1 each depict return stages of a multi-stage turbocompressor. An aerodynamic consideration of return stages is contained in US 2010/0272564 A1 and WO2014072288A1.

The conventional return stages of the prior art have different disadvantages, which the invention tries to avoid. The return stages, which are of rather simple design in geometric terms, are for the most part less well matched aerodynamically to the flow-related task, with the result that the complex three-dimensional flow situation remains disregarded at least in part, differences remaining unconsidered in particular above the vane height and disproportionately large flow losses, which reduce the efficiency, occurring accordingly. Other solutions, in particular the return stage according to WO2014072288A1, provide a completely three-dimensionally formed vane arrangement of the return stage, which is very difficult to realize in production terms and requires a complicated individual design, in order that a better efficiency than in the case of the simple geometry is at any rate obtained. In addition, major problems arise in the assembly of the return stage since, owing to the three-dimensional formation, the vane arrangement is frequently not able to allow conventional fastening elements between the vane base and the intermediate base that extend through the guide vanes. At this point, it is then possibly necessary for use to be made of expensive special solutions, and so a concept of this type ultimately has no chance on the market.

SUMMARY OF INVENTION

It is therefore an object of the invention to combine together the properties of simplified production, optimized aerodynamics and simple assembly.

To achieve the object, the invention proposes a return stage and a radial turbomachine as claimed. The dependent claims which refer back thereto in each case encompass advantageous refinements of the invention.

In principle, the return stage of a radial turbomachine serves for deflecting the process fluid from an impeller situated upstream from the radially outwardly directed flow direction radially inwardly again and axially feeding said process fluid to the following impeller situated downstream. Here, or in the present document, the terms "axial", "radial", "tangential", "circumferential direction" and the like are each in relation to the central axis about which the return stage extends in a ring-shaped manner. In a radial turbomachine, this axis is also the axis of rotation of a rotor or the shaft with the impellers.

The guide vane stage which is situated in the return stage comprises guide vanes which, in the circumferential direction, segment the ring form of the return stage into individual channels. In principle, it is also possible for these guide vanes to have interruptions (be split), these however advantageously being of uninterrupted form along the first flow direction according to the invention. The guide vanes have profiles which—correspondingly flattened—can also be represented two-dimensionally. A two-dimensional representation is possible for example if the ring-shaped channel of the return stage is cut along a mid-surface extending in the circumferential direction. This cut surface of a single guide vane can be flattened into a plane to form a two-dimensional representation. A profile midline of the profiles, stacked one above the other, of the guide vanes is able to be generated by means of centers of inscribed circles in the profile.

In this way, it is possible to define a profile midline path coordinate along the first throughflow direction along a mid-height of the respective guide vane. The length of the guide vane along said coordinate is expediently normalized to a total length of 1.

In the present case, the height direction of the guide vane is defined as the direction which is oriented perpendicular to the throughflow direction—in particular to the first throughflow direction—and perpendicular to the circumferential direction.

The profile midline of the guide vane that is directly adjacent to the outer delimiting contour of the ring-shaped channel of the return stage is referred to here as the outer track of the guide vane, and the profile midline of the profile cross section of the guide vane that is situated directly against the inner delimiting contour is referred to as the inner track of the guide vane. In this context, the outer delimiting contour of the return stage may also be referred to as cover shroud-side delimiting contour because an impeller provided with a cover shroud has said cover shroud on the side of the outer delimiting contour. The hub-side flow contour of the impeller is situated opposite thereto on the inner delimiting contour of the return stage, and so the inner delimiting contour of the return stage may also be referred to as the hub-side delimiting contour. Along the complex geometry of the return stage, the inner delimiting contour cannot always be considered as being situated radially further inward than the outer delimiting contour for identical positions along a central flowline through the return stage, and so such alternative designations are expedient for better understanding.

The circumferential position angle determines the respective position in the circumferential direction of the components referred to—here essentially reference points or lines of the guide vanes, for example points on profile midlines of particular profile cross sections. Here, the positive direction of progression of the circumferential position angle is selected counter to the direction of rotation of the shaft or of the rotor. The vertex of said angle coincides with the central axis. For a person skilled in the art, the return stage is always associated with a flow-related task, and so disassociation of the terminology of the return stage with regard to the direction of rotation of the turbomachine is fundamentally not expedient.

The three profile sections of the guide vanes of the guide vane stage differ from one another according to the invention on the basis of the focal points in terms of their functions. The first and the third profile section are associated to a large extent with an arcuate deflection of the process fluid, with the arcuate deflection being less involved in the second profile section than a flow-related task. All three profile sections are associated with either a deceleration or an acceleration of the process fluid, so that correspondingly demanding, superimposed aerodynamic processes also take place. The second profile section is moreover also particularly advantageous for serving for the leadthrough of at least one fastening element for the intermediate base to the vane base. The invention particularly takes into account these characteristics. Advantageously, the invention homogenizes the flow over the height extent of the guide vanes in that, in each case for values of L in the profile sections, it holds that:

in the first profile section (PS1):

$$\theta_{OTR}(L)\neq\theta_{ITR}(L) \text{ and } (\theta_{OTR}(L)-\theta_{ITR}(L))'\neq 0,$$

in the second profile section (PS2):

$$\theta_{OTR}(L)=\theta_{ITR}(L) \text{ and } (\theta_{OTR}(L)-\theta_{ITR}(L))'=0,$$

in the third profile section (PS3):

$$\theta_{OTR}(L)\neq\theta_{ITR}(L) \text{ and } (\theta_{OTR}(L)-\theta_{ITR}(L))'\neq 0.$$

Particularly expedient is a refining embodiment in which, in the first profile section, it holds that:

$$\theta_{OTR}(L)-\theta_{ITR}(L)>0,$$

wherein, in the third profile section (PS3), it holds that:

$$\theta_{OTR}(L)-\theta_{ITR}(L)<0.$$

One advantageous refinement of the invention provides that it holds that:

$$(\theta_{OTR}(L)-\theta_{ITR}(L))'=0 \text{ for exactly one } L \ni PS1,$$

$$(\theta_{OTR}(L)-\theta_{ITR}(L))'=0 \text{ for exactly one } L \ni PS2.$$

The middle, second profile section advantageously extends from at most L=0.4 to at least L=0.6.

For fastening the intermediate base to the vane base it is expedient for at least some of the guide vanes to have a cutout in the second profile section, extending from a point of the inner track to a point of the outer track, for the leadthrough of a fastening element between the inner delimiting contour and the outer delimiting contour. Advantageously, said cutout is closed to the lateral vane profile surfaces. Particularly advantageously, the cutout has a central straight axis of extent and may be formed in particular as a bore.

The efficiency of the return stage can be optimized further if the guide vanes are in each case arranged with an inlet edge in each case in the second section, advantageously in a region of the arcuate deflection of the second section between 0° and 90° of a first deflection angle with respect to the central axis.

In the arcuate deflections in the return stage, the deflection angle is in each case the difference in angle of a projection of the respective throughflow direction, in particular the first throughflow direction, of the return stage in an axial-radial plane from the inlet to the outlet of the deflecting section considered.

A further improvement to the aerodynamics is obtained in that the guide valves are in each case arranged with an outlet edge in each case in the fourth section, advantageously in a region of the arcuate deflection of the fourth section between 0° and 60° of a second deflection angle with respect to the axis.

A radial turbomachine according to the invention comprises a return stage of the type already described, wherein the axis, about which the return stage extends in a ring-shaped manner, is identical to the axis of rotation of a rotor or a shaft which carries impellers. Here, the return stage guides the flow from one impeller to a downstream impeller along the first throughflow direction.

The invention particularly expediently makes it possible for the ratio of an intermediate diameter to an outlet diameter to be less than 1.5, in particular less than 1.4, wherein the outlet diameter is the outlet diameter of the impeller situated upstream of the return stage and the intermediate diameter is the diameter of the transition cross section of the return stage from the first section to the second section.

BRIEF DESCRIPTION OF THE DRAWINGS

The invention is elucidated in more detail below on the basis of a specific exemplary embodiment with reference to drawings, in which.

DETAILED DESCRIPTION OF INVENTION

Figure 1:
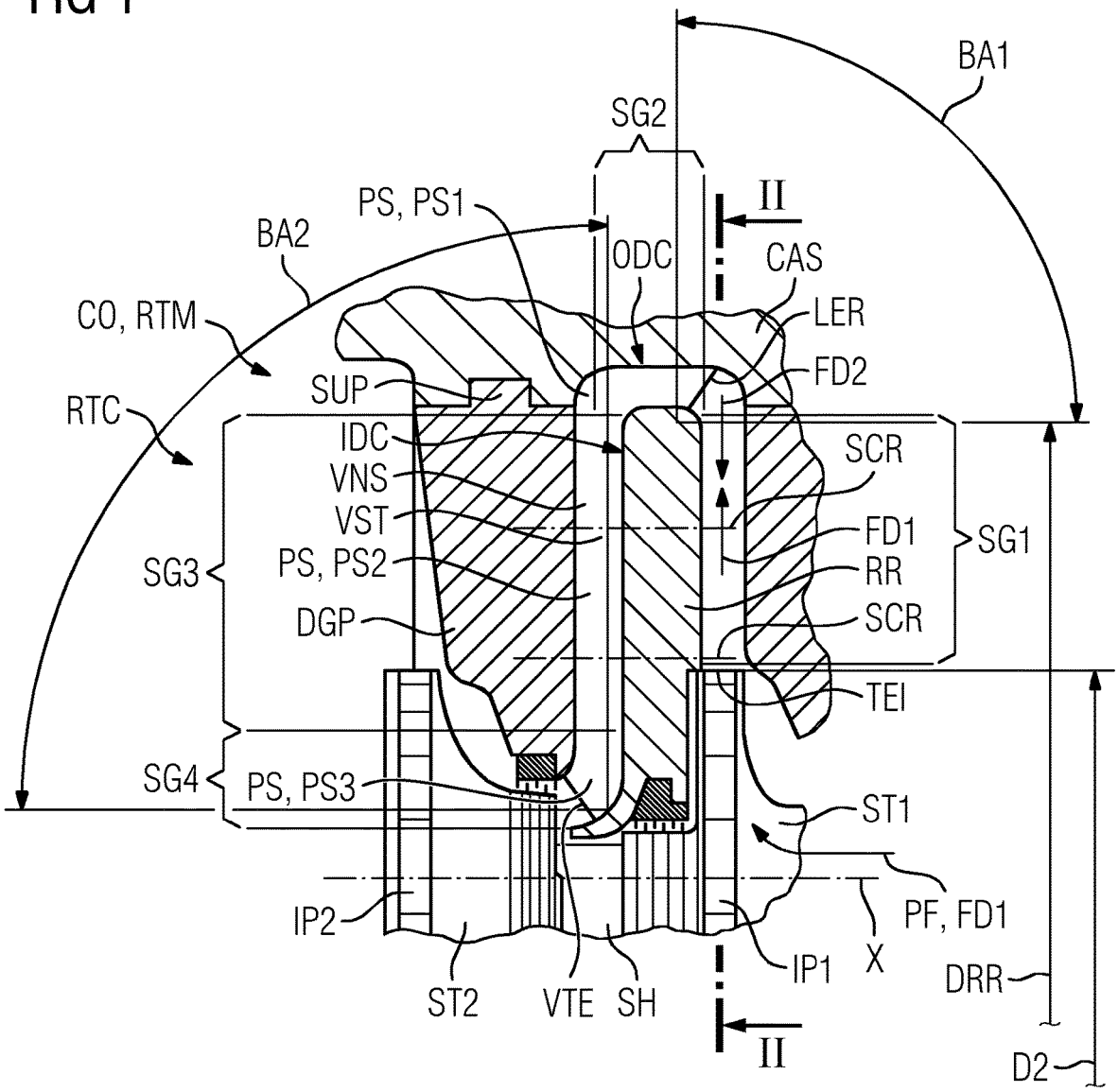
FIG. 1 schematically shows an axial longitudinal section through the detail of a housing of a radial turbomachine having a return stage and impellers, FIG. 2 schematically shows an illustration of a cross section according to the section II-II indicated in FIG. 1, FIG. 3 schematically shows a three-dimensional reproduction of the guide vane stage of a return stage according to the invention together with an intermediate base, and FIG. 4 schematically shows the progression of the difference in circumferential position angle between the outer track and the inner track of the profile midline of individual guide vanes of the guide vane stage of the return stage plotted over the profile length path coordinate along the first flow direction, which profile length path coordinate is normalized to 1 (so as to be dimensionless).

FIG. 1 shows a return stage RTC of a radial turbomachine RTM which is formed as a radial turbocompressor (CO).

The components elucidated here by way of example for a radial turbocompressor CO are, according to the invention, also able to be implemented in a structurally identical form as a radial turboexpander, wherein a process fluid PF flows through said components in a radial turbocompressor CO in a first throughflow direction FD1, and in a radial turboexpander in an opposite, second throughflow direction FD2. In the present document, the descriptions always refer to the first throughflow direction FD1, unless indicated otherwise.

FIG. 1 shows parts of two stages which are flowed through in succession, a first stage ST1 and a second stage ST2, of a radial turbomachine RTM, or radial turbocompressor CO, illustrated in a detail, wherein here, a return stage RTC between the two stages ST1, ST2 is illustrated entirely schematically. The two stages ST1, ST2 are illustrated here with impellers which are arranged in a manner rotatable about the axis of rotation X, a first impeller IP1 and a second impeller IP2.

In the illustration in FIG. 1, a process fluid PF firstly flows through the first impeller IP1 along a first throughflow direction FD1 in an axially inflowing and radially outflowing manner. Merely by way of example, an oppositely directed, second throughflow direction FD2 is also indicated, as would exist in a radial expander. Following the first impeller IP1 downstream, the process fluid PF reaches a radially outwardly directed first section SG1 in a radially outwardly flowing manner and is decelerated there, passes downstream into an approximately 180° deflection of a second section SG2 and then into a radially inwardly directed return of a third section SG3 of the return stage RTC. Downstream of the third section SG3, in a fourth section SG4, the process fluid PF passes into the second impeller IP2 in a manner deflected from a radially inwardly flowing state to an axially flowing state, so as there to be accelerated radially outwardly again.

The return stage RTC comprises a vane base RR, guide vanes VNS and an intermediate base DGP. The intermediate base DGP is, by means of at least one support SUP, supported in a support device—in a housing CAS in this case—and positioned there. Here, the support SUP and the supporting section of the housing CAS are formed in a form-fitting manner as a tongue-and-groove connection.

In a manner not illustrated in more detail, the return stage RTC has, or the vane base RR and the intermediate base DGP have, a split joint which extends in a common plane substantially along the axis X. Expediently for the assembly, said split joint is situated in the same split joint plane as a split joint (not illustrated) of the housing CAS.

In principle, it is also conceivable for the rotor to be of splittable form between two impellers, or for the impellers to be formed to be axially mutually displaceable for the purpose of assembly, so that the return stages RTC may be of non-splittable form and are assembled together with the impellers IP1, IP2 of the rotor in a stepwise manner before a joining process with a surrounding housing takes place. The housing CAS may at any rate be of horizontally or vertically splittable form.

The conventional formation of the return stage RTC, which is shown in FIG. 1, provides that the vane base RR, the guide vanes VNS and the intermediate base DGP are fastened to one another. In the present case, this is done by means of screws SCR, which are illustrated in a simplified manner by means of dash-dotted lines. Since, on the one hand, the screws SCR have to sufficiently fasten the vane base RR to the intermediate base DGP and thus have to have a minimum thickness, on the other hand, a sufficiently large passage bore has to be provided in the guide vanes VNS, and so the profile of the guide vanes VNS has to be of sufficiently thick form.

The guide vanes are divided into three successive profile sections PS along the first throughflow direction FD1:

a first profile section PS1, a second profile section PS2, a third profile section PS3.

Figure 2:
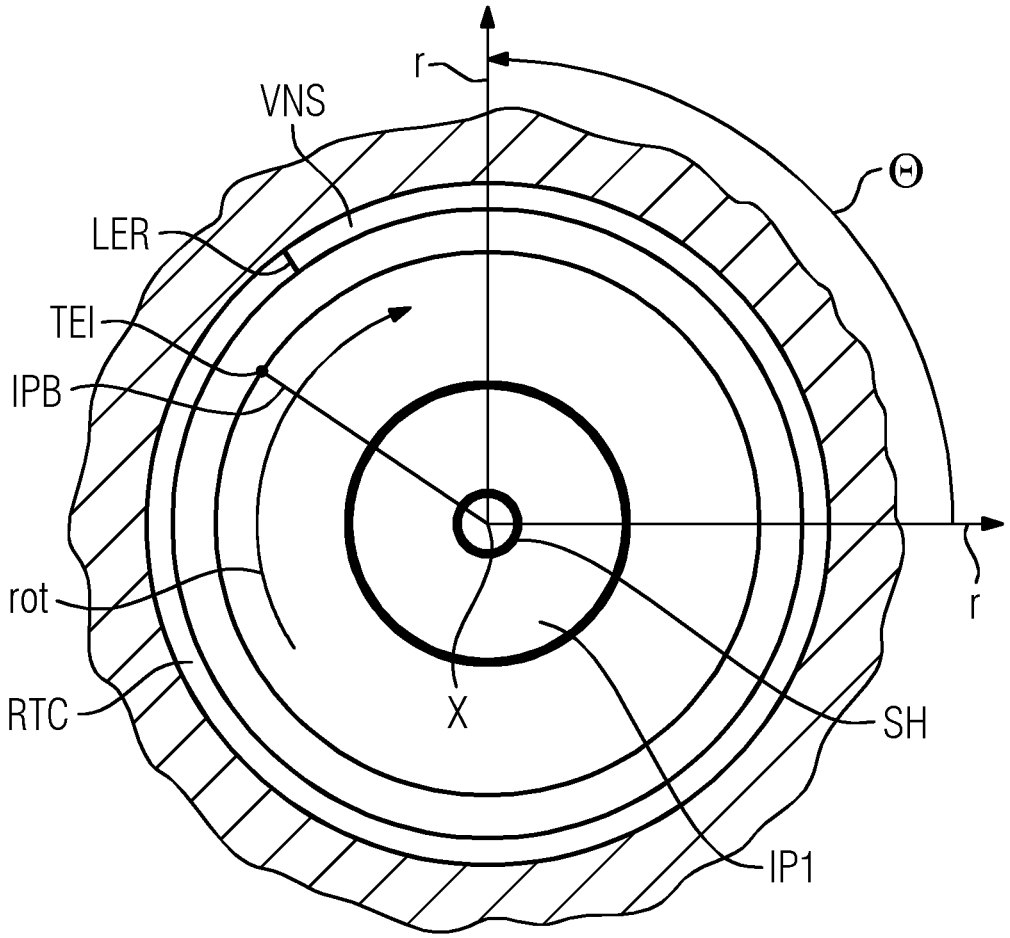

FIG. 2 schematically shows a cross section through a radial turbomachine RTM according to the invention as indicated in FIG. 1 by II-II. The first impeller IP1, which is fitted on the shaft SH, is mounted in a manner rotatable about the axis X along the direction of rotation ROT. By way of example, the directions radially horizontal and vertical are shown. The circumferential position angle θ has a positive progression counter to the direction of rotation ROT. Shown by way of example, the first impeller IP1 has rotor blades IPB of a rotor blade stage. For one rotor blade IPB, the outlet edge TEI is labelled. The return stage RTC extends downstream of the first impeller IP1. The return stage RTC has a guide vane stage VST, which has guide vanes VNS, of which one is shown by way of example. The schematically shown guide vane VNS is illustrated merely with its inlet edge LER. Overall, FIG. 2 shows the dependency between the direction of rotation ROT of the shaft SH, or of the impellers IP1, IP2, and the circumferential position angle θ.

Figure 3:
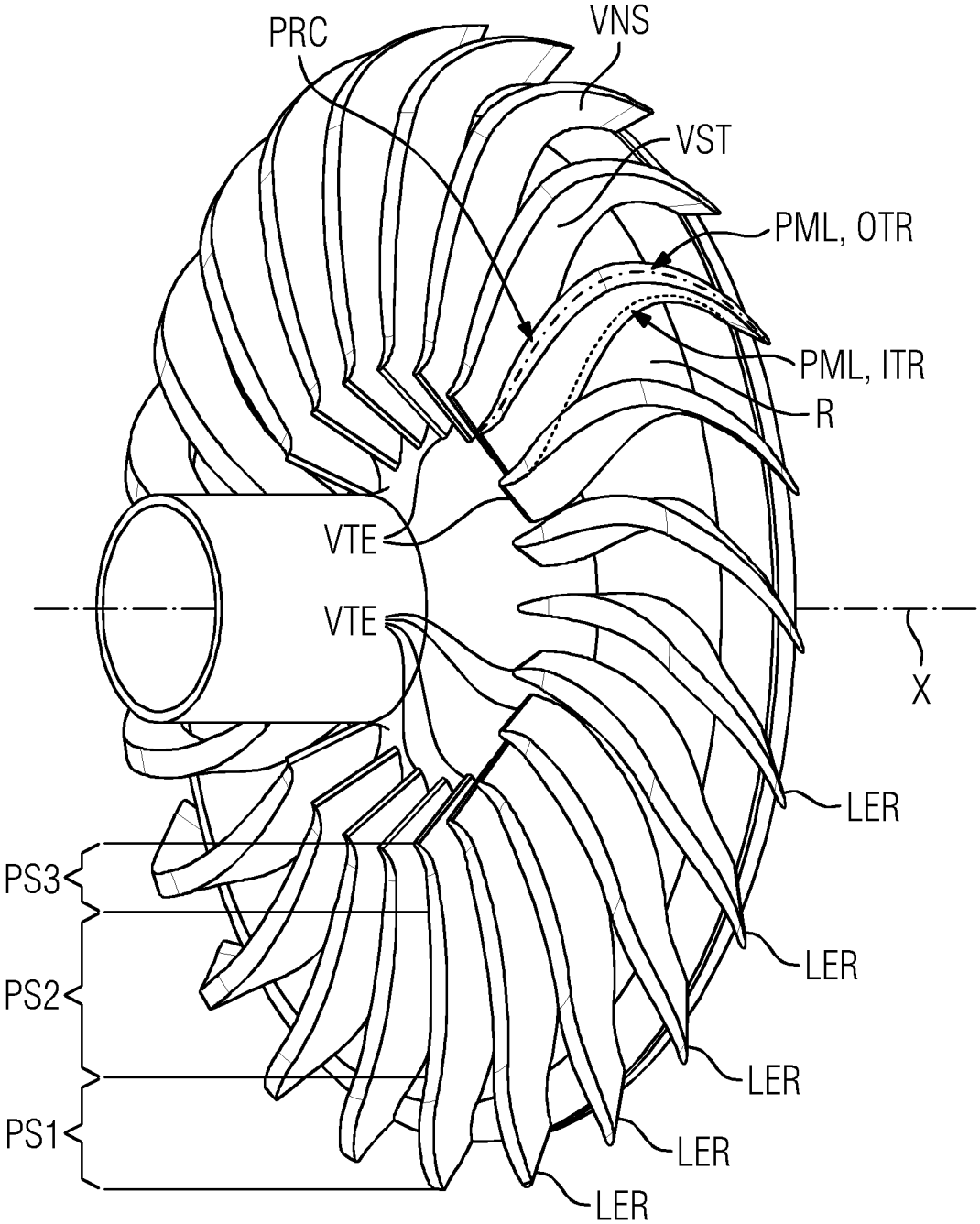

FIG. 3 shows, in three dimensions, parts of the return stage RTC, specifically the guide vane stage VST having the guide vanes VNS, and the three-dimensional shape thereof.

Figure 4:
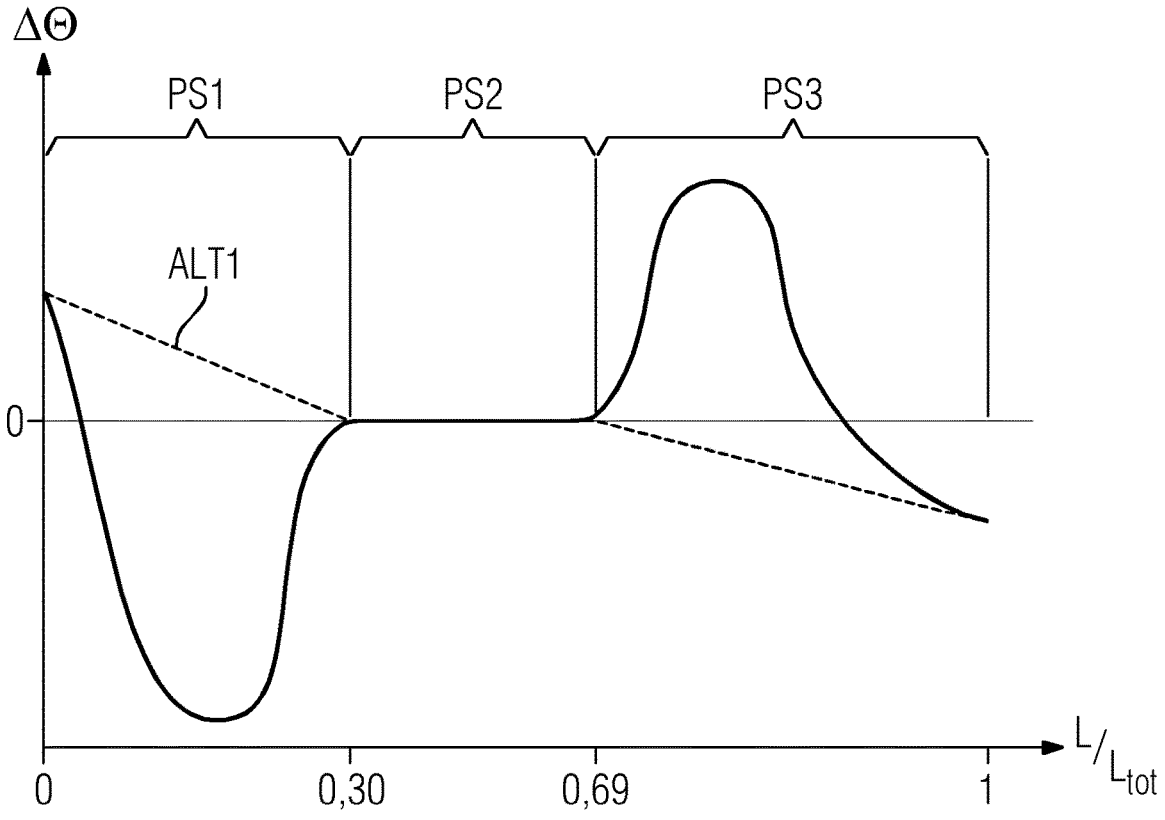

FIG. 4 shows the progression of the difference between the circumferential position angle of the outer track and the inner track plotted over the profile midline path coordinate L, which is indicated normalized to a total length of 1. A first alternative ALT1 provides that the difference is firstly positive and then, at approximately 0.3 L, drops to zero, where it remains constant until, at approximately 0.65 L, Δθ drops into the negative range. A second alternative ALT2 provides that the circumferential position angle difference Δθ is firstly positive in the region of the inlet edge LER, then drops into the negative range, where it has a local minimum and rises again to a difference of 0 at approximately 0.3 L. There, Δθ remains constant until approximately 0.65 L, and then rises into the positive range up to a local maximum, so as then to drop back into the negative range. In both cases, in a first profile section PS1, the circumferential position angle difference is not equal to 0 (apart from at a point of intersection with the 0-axis), just like in the third profile section PS3. In the second profile section PS2 in the middle of the respective guide vane VNS, a constant circumferential position angle difference of 0 is obtained.

The invention claimed is:

1. A return stage (RTC) for throughflow by means of a process fluid along a throughflow direction of a radial turbomachine (RTM), wherein the return stage (RTC) extends about an axis (X) in a ring-shaped manner, wherein the return stage (RTC) is defined radially inwardly by an inner delimiting contour (IDC) and radially outwardly by an outer delimiting contour (ODC), wherein the return stage (RTC) extends radially outwardly in a first section (SG1) along a first throughflow direction (FD1), wherein the return stage (RTC) extends, in a manner describing an arcuate deflection, radially inward from radially outside along the first throughflow direction (FD1) in a second section (SG2), wherein the return stage (RTC) extends radially inward from radially outside along the first throughflow direction (FD1) in a third section (SG3), wherein the return stage (RTC) extends, in a manner describing an arcuate deflection, axially from radially inside along the first throughflow direction (FD1) in a fourth section (SG4), wherein at least one guide vane stage (VST) comprising guide vanes (VNS) extends at least along a part of the third section (SG3) and, in the circumferential direction, segments the return stage into flow channels, wherein each guide vane of the guide vanes (VNS) in the guide vane stage (VST) has a respective profile midline (PML) of a respective profile cross section (PRC) that defines an inner track (ITR) on a side of the inner delimiting contour (IDC) and an outer track (OTR) on a side of the outer delimiting contour (ODC), wherein respective progressions of the inner track (ITR) and outer track (OTR) are defined as, $$\theta(L)=F_\theta(L)$$

$$R(L)=F_R(L),$$

with θ: circumferential position angle in a direction of rotation of the radial turbomachine (RTM), with the vertex on the axis (X), L: profile midline path coordinate along the first throughflow direction (FD1) along a mid-height of the respective guide vane (VNS), normalized to a total length of 1, $F_\theta(L)$: functional relationship between circumferential position angle θ and position L on the profile midline, $F_R(L)$: functional relationship between radius R and position L on the profile midline, R: radius of the position of the inner track (ITR) or outer track (OTR), wherein the guide vanes (VNS) have three successive profile sections (PS) along the first throughflow direction (FD1);

a first profile section (PS1), a second profile section (PS2), a third profile section (PS3), wherein, for values of L in the profile sections, it holds that:

in the first profile section (PS1):

$$\theta_{OTR}(L)\neq\theta_{ITR}(L) \text{ and } (\theta_{OTR}(L)-\theta_{ITR}(L))'\neq 0 \text{ for all but one } L,$$

in the second profile section (PS2):

$$\theta_{OTR}(L)=\theta_{ITR}(L) \text{ and } (\theta_{OTR}(L)-\theta_{ITR}(L))'=0,$$

in the third profile section (PS3):

$$\theta_{OTR}(L)\neq\theta_{ITR}(L) \text{ and } (\theta_{OTR}(L)-\theta_{ITR}(L))'\neq 0 \text{ for all but one } L,$$

wherein it holds that:

$$(\theta_{OTR}(L)-\theta_{ITR}(L))'=0 \text{ for exactly one } L\ni PS1,$$

$(\theta_{OTR}(L)-\theta_{ITR}(L))'=0$ for exactly one L∋PS3.

2. The return stage (RTC) as claimed in claim 1, wherein, in the first profile section (PS1) there is a local minimum, and wherein, in the third profile section (PS3) there is a local minimum.

3. The return stage (RTC) as claimed in claim 1, wherein the second profile section (PS2) extends from L=0.4 to L=0.6.

4. The return stage (RTC) as claimed in claim 1, wherein at least some of the guide vanes (VNS) have a cutout in the second profile section (PS2), extending from a point of the inner track to a point of the outer track, for a leadthrough of a fastening element between the inner delimiting contour (IDC) and the outer delimiting contour (ODC).

5. The return stage (RTC) as claimed in claim 4, wherein the fastening element comprises screws arranged to fasten a vane base (RR) to an intermediate base (DGP).

6. The return stage (RTC) as claimed in claim 1, wherein the guide vanes (VNS) is each arranged with a respective inlet edge (LER) in the second section (SG2), in a region of the arcuate deflection of the second section (SG2) between 0° and 90° of a first deflection angle (BA1).

7. The return stage (RTC) as claimed in claim 1, wherein the guide vanes (VNS) is each arranged with a respective outlet edge (VTE) in the fourth section (SG4), in a region of the arcuate deflection of the fourth section (SG4) between 0° and 60° of a second deflection angle (BA2).

8. The return stage (RTC) as claimed in claim 1, wherein the return stage (RTC) is a radial turbocompressor return stage (RCC).

9. A radial turbomachine (RTM) comprising:

a rotor (ROT) which is rotatable about an axis (X);

at least two impellers (IP1, IP2) connected to the rotor; and a return stage (RTC) arranged to guide flow of a process fluid from one impeller (IP1, IP2) to a downstream impeller (IP1, IP2) along a first throughflow direction (FD1), wherein the return stage (RTC) extends about the axis (X) in a ring-shaped manner, wherein the return stage (RTC) is defined radially inwardly by an inner delimiting contour (IDC) and radially outwardly by an outer delimiting contour (ODC), wherein the return stage (RTC) extends radially outwardly in a first section (SG1) along the first throughflow direction (FD1), wherein the return stage (RTC) extends, in a manner describing an arcuate deflection, radially inwardly from radially outside along the first throughflow direction (FD1) in a second section (SG2), wherein the return stage (RTC) extends radially inwardly from radially outside along the first throughflow direction (FD1) in a third section (SG3), wherein the return stage (RTC) extends, in a manner describing an arcuate deflection, axially from radially inside along the first throughflow direction (FD1) in a fourth section (SG4), wherein at least one guide vane stage (VST) comprising guide vanes (VNS) extends at least along a part of the third section (SG3) and, in the circumferential direction, segments the return stage into flow channels, wherein each guide vane of the guide vanes (VNS) in the guide vane stage (VST) has a respective profile midline (PML) of a respective profile cross section (PRC) that defines an inner track (ITR) on a side of the inner delimiting contour (IDC) and an outer track (OTR) on a side of the outer delimiting contour (ODC), wherein respective progressions of the inner track (ITR) and outer track (OTR) are defined as:

$$\theta(L)=F_\theta(L)$$

$$R(L)=F_R(L),$$

with θ: circumferential position angle in a direction of rotation of the radial turbomachine (RTM), with the vertex on the axis (X), L: profile midline path coordinate along the first throughflow direction (FD1) along a mid-height of the respective guide vane (VNS), normalized to a total length of 1, $F_\theta(L)$: functional relationship between circumferential position angle θ and position L on the profile midline, $F_R(L)$: functional relationship between radius R and position L on the profile midline, R: radius of the position of the inner track (ITR) or outer track (OTR), wherein the guide vanes (VNS) have three successive profile sections (PS) along the first throughflow direction (FD1):

a first profile section (PS1), a second profile section (PS2), a third profile section (PS3), wherein, for values of L in the profile sections, it holds that:

in the first profile section (PS1):

$$\theta_{OTR}(L)\neq\theta_{ITR}(L) \text{ and } (\theta_{OTR}(L)-\theta_{ITR}(L))'\neq 0 \text{ for all but one } L,$$

in the second profile section (PS2):

$$\theta_{OTR}(L)=\theta_{ITR}(L) \text{ and } (\theta_{OTR}(L)-\theta_{ITR}(L))'=0,$$

in the third profile section (PS3):

$$\theta_{OTR}(L)\neq\theta_{ITR}(L) \text{ and } (\theta_{OTR}(L)-\theta_{ITR}(L))'\neq 0 \text{ for all but one } L,$$

wherein it holds that:

$$(\theta_{OTR}(L)-\theta_{ITR}(L))'=0 \text{ for exactly one } L\ni PS1,$$

$$(\theta_{OTR}(L)-\theta_{ITR}(L))'=0 \text{ for exactly one } L\ni PS3.$$

10. The radial turbomachine (RTM) as claimed in claim 9, wherein the impellers (IP1, IP2) have an outlet diameter (D2) upstream of the return stage (RTC), wherein a transition cross section of the return stage from the first section (SG1) to the second section (SG2) is arranged at an intermediate diameter (DRR), wherein it holds that:

$$DRR/D2<1.5,$$

with:

D2: outlet diameter of impellers (IP1, IP2)

DRR: intermediate diameter of the transition cross section of the return stage from the first section (SG1) to the second section (SG2).

11. The radial turbomachine (RTM) as claimed in claim 10, wherein it holds that:

$$DRR/D2<1.4.$$

12. The radial turbomachine (RTM) as claimed in claim 9, wherein the radial turbomachine (RTM) is a radial turbocompressor.

* * * * *